US007270384B2

(12) United States Patent
Koloff, Jr. et al.

(10) Patent No.: US 7,270,384 B2
(45) Date of Patent: Sep. 18, 2007

(54) SUPPORT ASSEMBLY FOR A REFRIGERATOR STORAGE PAN

(75) Inventors: Phillip Eugene Koloff, Jr., Louisville, KY (US); Joseph Murphy Miller, Louisville, KY (US); Amarnath Nithyananda Bangalore, Karnataka (IN)

(73) Assignee: General Electric Company, Schenectady, NY (US)

( * ) Notice: Subject to any disclaimer, the term of this patent is extended or adjusted under 35 U.S.C. 154(b) by 219 days.

(21) Appl. No.: 10/701,861

(22) Filed: Nov. 5, 2003

(65) Prior Publication Data

US 2005/0093408 A1 May 5, 2005

(51) Int. Cl.
*A47B 96/04* (2006.01)
*A47B 88/00* (2006.01)

(52) U.S. Cl. ..... 312/404; 312/330.1

(58) Field of Classification Search ..... 312/404, 312/401, 119, 318, 330.1, 334.1, 334.7, 348.1, 312/348.2, 350, 265.1, 265.4, 334.22; 248/248, 248/300, 301; 211/85.31, 126.9, 133.2
See application file for complete search history.

(56) References Cited

U.S. PATENT DOCUMENTS 1,459,404 A * 6/1923 Kleffman ..... 248/220.21
2,155,284 A * 4/1939 Steenstrup ..... 62/457.1
2,386,150 A * 10/1945 Swedman ..... 312/404
2,564,473 A * 8/1951 Ferguson ..... 312/408
2,793,416 A * 5/1957 Yearling ..... 249/6
2,936,077 A * 5/1960 Carpenter ..... 211/126.15
3,352,431 A * 11/1967 Smith ..... 211/208
3,565,382 A * 2/1971 Passarelli, Jr. ..... 248/300
3,611,661 A * 10/1971 Chambers ..... 52/94
4,139,174 A * 2/1979 Olson ..... 248/317
4,241,668 A * 12/1980 Carroll ..... 108/26
4,283,038 A * 8/1981 Kurtz ..... 248/478
4,303,039 A * 12/1981 Thibault ..... 119/52.1
4,729,613 A 3/1988 Tromble et al.
4,967,989 A * 11/1990 Bender ..... 248/188.1
5,044,704 A 9/1991 Bussan et al.
5,083,848 A * 1/1992 Merino et al. ..... 312/334.42
5,251,974 A * 10/1993 Beals ..... 312/330.1
5,582,376 A * 12/1996 Thompson ..... 248/214
5,641,217 A 6/1997 Caruso et al.
5,875,902 A * 3/1999 Emery et al. ..... 211/90.03
6,416,145 B1 * 7/2002 Singh ..... 312/334.1
D462,539 S * 9/2002 Segall ..... D6/411
6,491,173 B1 * 12/2002 Costa ..... 211/126.15
6,578,720 B1 * 6/2003 Wang ..... 211/126.15
6,675,603 B1 1/2004 Lesyna et al.
6,938,617 B2 * 9/2005 Le et al. ..... 126/339

(Continued)

FOREIGN PATENT DOCUMENTS

DE 29614997 * 10/1996

*Primary Examiner*—Janet M. Wilkens
*Assistant Examiner*—Timothy M. Ayres
(74) *Attorney, Agent, or Firm*—George L. Rideout, Esq.; Armstrong Teasdale LLP

(57) ABSTRACT

A refrigerator drawer assembly includes a pan support that includes a wire member that has a first side and a second side. A first bracket is coupled to the first side using a first coupling system. A second bracket is coupled to the second side using a second coupling system different than the first coupling system. The second bracket is substantially identical to the first bracket.

12 Claims, 7 Drawing Sheets

U.S. PATENT DOCUMENTS 6,938,784 B2 * 9/2005 Yang ..... 312/330.1
6,969,133 B2 * 11/2005 Compagnucci ..... 312/334.6
2002/0084734 A1 * 7/2002 Shih ..... 312/334.4
2003/0173882 A1 * 9/2003 Koons ..... 312/404

* cited by examiner

SUPPORT ASSEMBLY FOR A REFRIGERATOR STORAGE PAN

BACKGROUND OF THE INVENTION

This invention relates generally to refrigerator storage chambers, and more particularly, to a support assembly for a refrigerator storage pan.

A typical household refrigerator includes a freezer storage compartment and a fresh food storage compartment either arranged side-by-side and separated by a center mullion wall or over-and-under and separated by a horizontal center mullion wall. Storage shelves and storage drawers or pans typically are provided in the fresh food compartment, and storage shelves and wire baskets typically are provided in the freezer compartment. In some refrigerators, the storage pans may be maintained at a temperature that is different from the temperature of the compartment in which the storage pan is located. In addition, an ice maker may be provided in the freezer compartment. A freezer door and a fresh food door close the access openings to the freezer and fresh food compartments, respectively.

Storage pans are typically provided in a lower portion of the refrigerator for storing fresh fruits and vegetables or in some cases, fresh meats. The storage pans are generally suspended from a support structure that includes a track or glide that facilitates sliding movement of the storage pan in and out of the compartment.

While slide-out storage drawers and pans are desirable for convenient access, they can be difficult to use. In at least some known refrigerators, the storage pan can unexpectedly come all of the way out of its track, spilling the contents of the pan when a user tries to fully open the drawer. Alternatively, in other refrigerators, the travel of the storage pan is limited so that it doesn't easily come all of the way out, which limits access to the contents of the pan. Such pans may also be difficult to remove for cleaning.

BRIEF DESCRIPTION OF THE INVENTION

In one aspect, a refrigerator drawer assembly includes a pan support that includes a wire member that has a first side and a second side. A first bracket is coupled to the first side using a first coupling system. A second bracket is coupled to the second side using a second coupling system different than the first coupling system. The second bracket is substantially identical to the first bracket.

In another aspect, a refrigerator drawer assembly includes a pan support that includes a wire member having a first side and a second side. A first bracket is coupled to the first side such that the first bracket is removable without tools. A second bracket is coupled to the second side such that the second bracket is removable without tools.

In another aspect, a method for assembling a refrigerator drawer assembly is provided. The method includes providing a pan support wire member having a first side and a second side, providing a plurality of substantially identical brackets including a first bracket and a second bracket, removably coupling the first bracket to the first side in a first manner, and removably coupling the second bracket to the second side in a second manner different from the first manner.

In another aspect, a bracket includes a sidewall and a first rail extending from the sidewall. The first rail includes a plurality of slots sized to receive a first U-shaped member extending from a pan support wire member. A second rail also extends from the sidewall. The second rail includes at least one of a plurality of slots sized to receive a second U-shaped member extending from the pan support wire member and a plurality of apertures each sized to receive a hook extending from the pan support wire member.

DETAILED DESCRIPTION OF THE INVENTION

Figure 1:
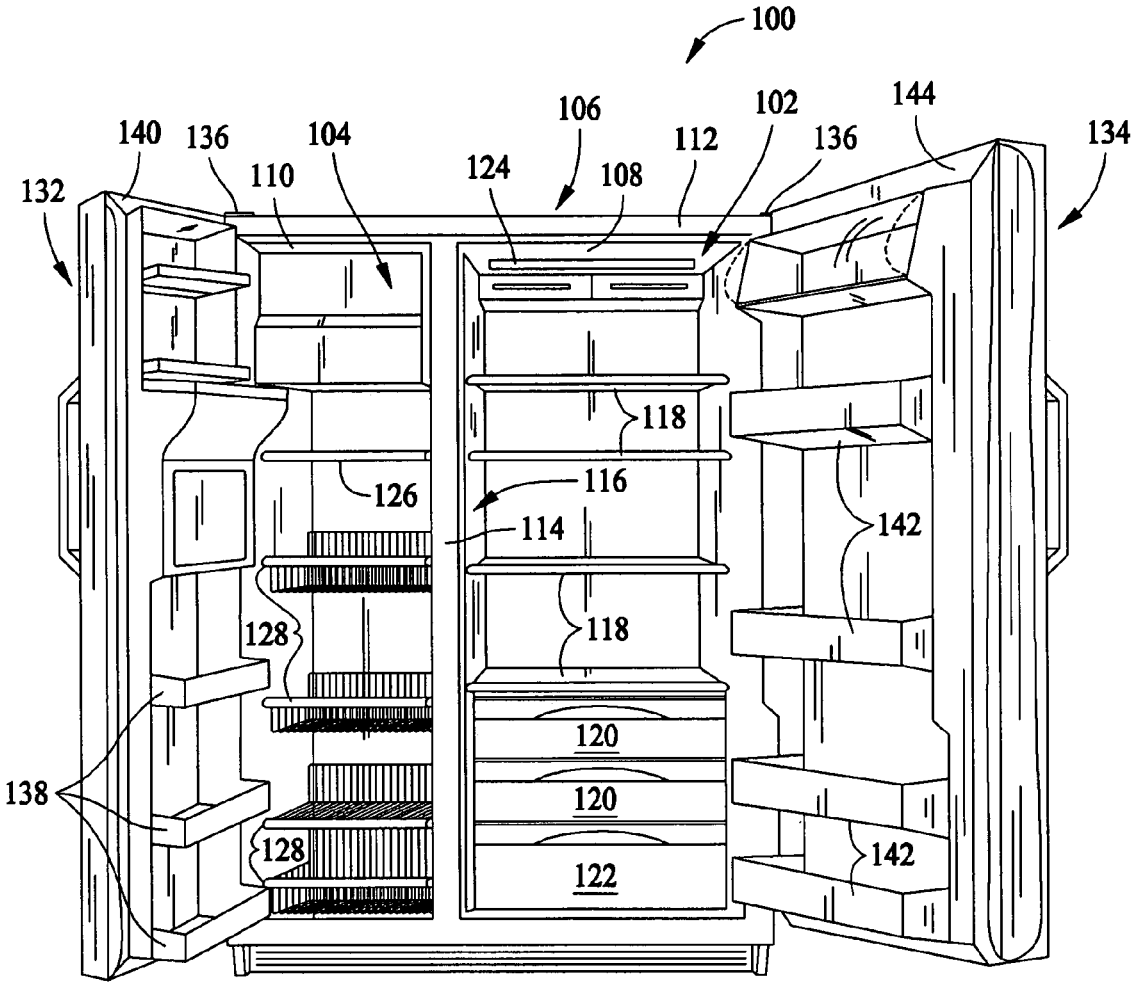
FIG. 1 is a perspective view of a refrigerator.

FIG. 1 illustrates a side-by-side refrigerator 100 including a fresh food storage compartment 102 and freezer storage compartment 104. Freezer compartment 102 and fresh food compartment 104 are arranged side-by-side. A side-by-side refrigerator similar to refrigerator 100 is commercially available from General Electric Company, Appliance Park, Louisville, Ky. 40225.

Refrigerator 100 includes an outer case 106 and inner liners 108 and 110. A space between case 106 and liners 108 and 110, and between liners 108 and 110, is filled with foamed-in-place insulation. Outer case 106 normally is formed by folding a sheet of a suitable material, such as pre-painted steel, into an inverted U-shape to form top and side walls of case. A bottom wall of case 106 normally is formed separately and attached to the case side walls and to a bottom frame that provides support for refrigerator 100. Inner liners 108 and 110 are molded from a suitable plastic material to form freezer compartment 104 and fresh food compartment 106, respectively. Alternatively, liners 108, 110 may be formed by bending and welding a sheet of a suitable metal, such as steel. The illustrative embodiment includes two separate liners 108, 110 as it is a relatively large capacity unit and separate liners add strength and are easier to maintain within manufacturing tolerances. In smaller refrigerators, a single liner is formed and a mullion spans between opposite sides of the liner to divide it into a freezer compartment and a fresh food compartment.

A breaker strip 112 extends between a case front flange and outer front edges of liners. Breaker strip 112 is formed from a suitable resilient material, such as an extruded acrylo-butadiene-syrene based material (commonly referred to as ABS).

The insulation in the space between liners 108, 110 is covered by another strip of suitable resilient material, which also commonly is referred to as a mullion 114. Mullion 114 also preferably is formed of an extruded ABS material. It will be understood that in a refrigerator with separate mullion dividing an unitary liner into a freezer and a fresh food compartment, a front face member of mullion corresponds to mullion 114. Breaker strip 112 and mullion 114 form a front face, and extend completely around inner peripheral edges of case 106 and vertically between liners 108, 110. Mullion 114, insulation between compartments, and a spaced wall of liners separating compartments, sometimes are collectively referred to herein as a center mullion wall 116.

Shelves 118 and slide-out drawers 120 normally are provided in fresh food compartment 102 to support items being stored therein. Refrigerator 100 also includes a bottom pan 122 that may be a part of a quick chill and thaw system (not shown in FIG. 1) that is selectively controlled, together with other refrigerator features, by a microprocessor (not shown in FIG. 1) according to user preference via manipulation of a control interface 124 mounted in an upper region of fresh food storage compartment 102 and coupled to the microprocessor. Shelves 126 and wire baskets 128 are also provided in freezer compartment 104. In addition, an ice maker 130 may be provided in freezer compartment 104.

A freezer door 132 and a fresh food door 134 close access openings to fresh food and freezer compartments 102, 104, respectively. Each door 132, 134 is mounted by a top hinge 136 and a bottom hinge (not shown) to rotate about its outer vertical edge between an open position, as shown in FIG. 1, and a closed position (not shown) closing the associated storage compartment. Freezer door 132 includes a plurality of storage shelves 138 and a sealing gasket 140, and fresh food door 134 also includes a plurality of storage shelves 142 and a sealing gasket 144.

Figure 2:
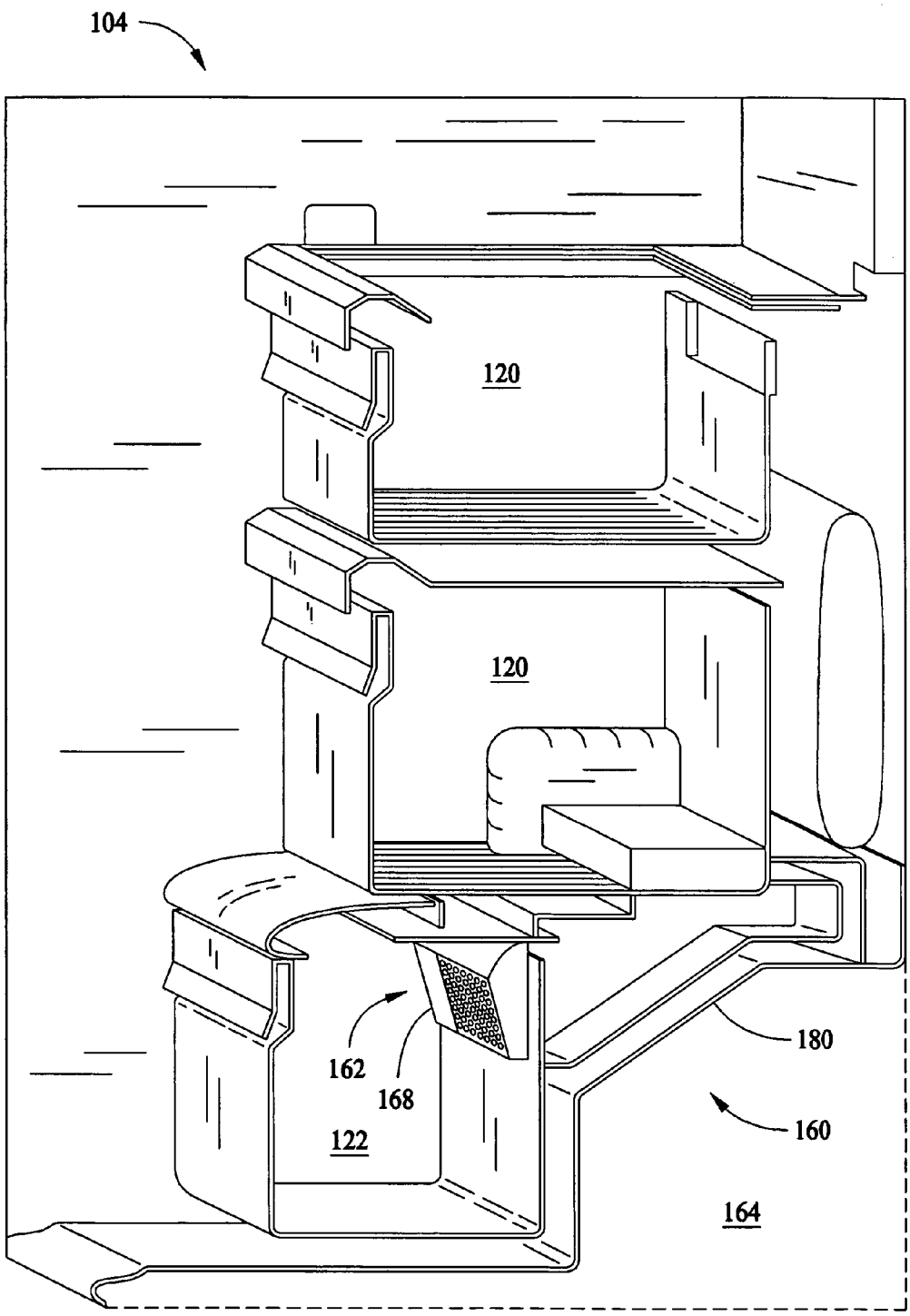
FIG. 2 is a partial perspective cut away view of a portion of FIG. 1.

FIG. 2 is a partial cutaway view of fresh food compartment 102 illustrating storage drawers 120 stacked upon one another and positioned above a quick chill and thaw system 160. Quick chill and thaw system 160 includes an air handler 162 and pan 122 located adjacent a machinery compartment 164 (shown in phantom in FIG. 2) to minimize fresh food compartment space utilized by quick chill and thaw system 160. A leading edge 168 of air handler 162 projects into pan 122. Storage drawers 120 are conventional slide-out drawers without internal temperature control. A temperature of storage drawers 120 is therefore substantially equal to an operating temperature of fresh food compartment 102. Bottom pan 122 is positioned slightly forward of storage drawers 120 to accommodate machinery compartment 164, and air handler 162 selectively controls a temperature of air in pan 122 and circulates air within pan 122 to increase heat transfer to and from pan contents for timely thawing and rapid chilling, respectively, as described in detail below. When quick thaw and chill system 160 is inactivated, pan 122 reaches a steady state at a temperature equal to the temperature of fresh food compartment 102, and pan 122 functions as a third storage drawer. In alternative embodiments, greater or fewer numbers of storage drawers 120 and quick chill and thaw systems 160, and other relative sizes of quick chill pans 122 and storage drawers 120 are employed.

In accordance with known refrigerators, machinery compartment 164 at least partially contains components for executing a vapor compression cycle for cooling air. The components include a compressor (not shown), a condenser (not shown), an expansion device (not shown), and an evaporator (not shown) connected in series and charged with a refrigerant. The evaporator is a type of heat exchanger which transfers heat from air passing over the evaporator to a refrigerant flowing through the evaporator, thereby causing the refrigerant to vaporize. The cooled air is used to refrigerate one or more refrigerator or freezer compartments.

Figure 3A:
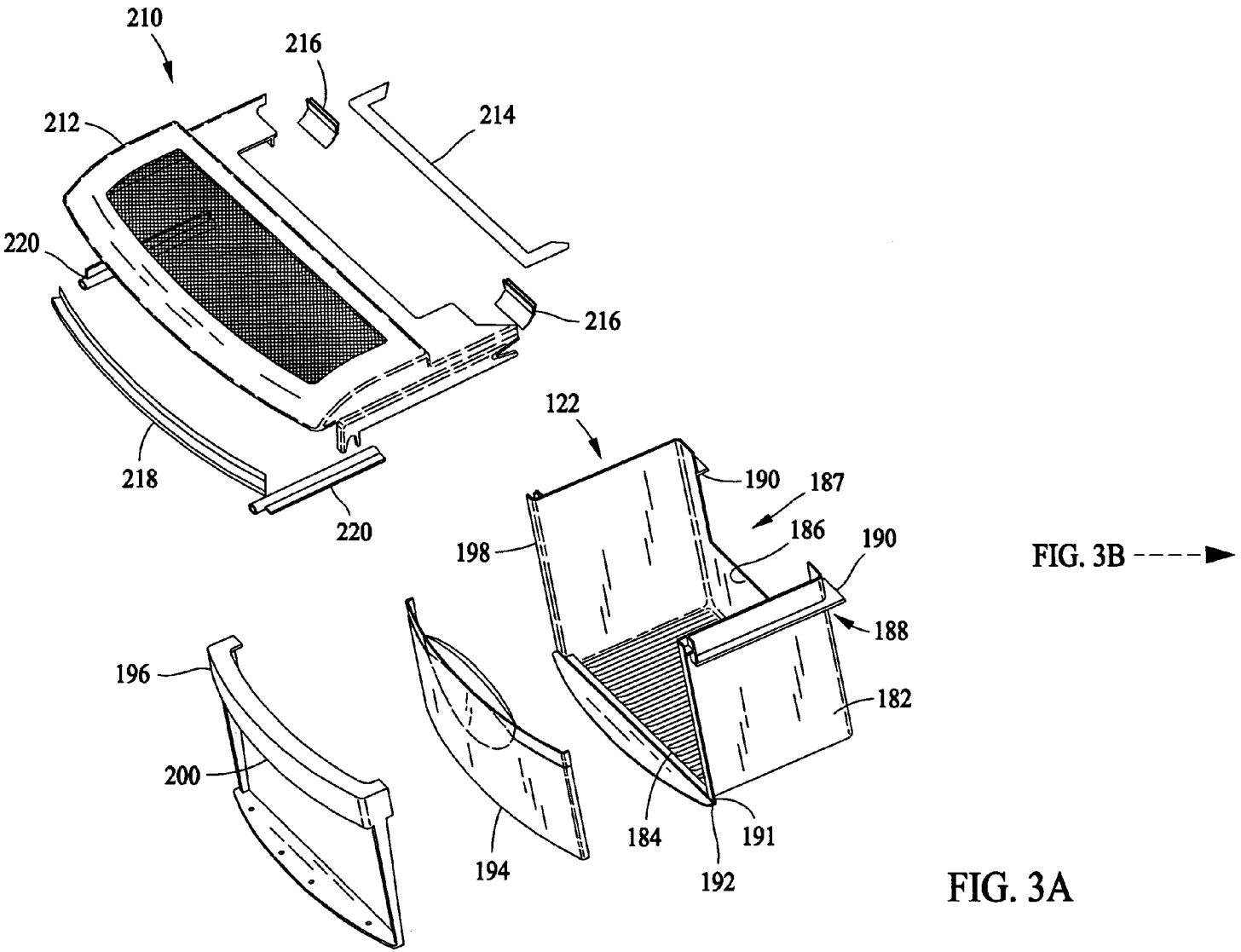
FIGS. 3A and 3B show a perspective exploded view illustrating a bottom pan assembly and support assembly.
Figures 3A, 3B:
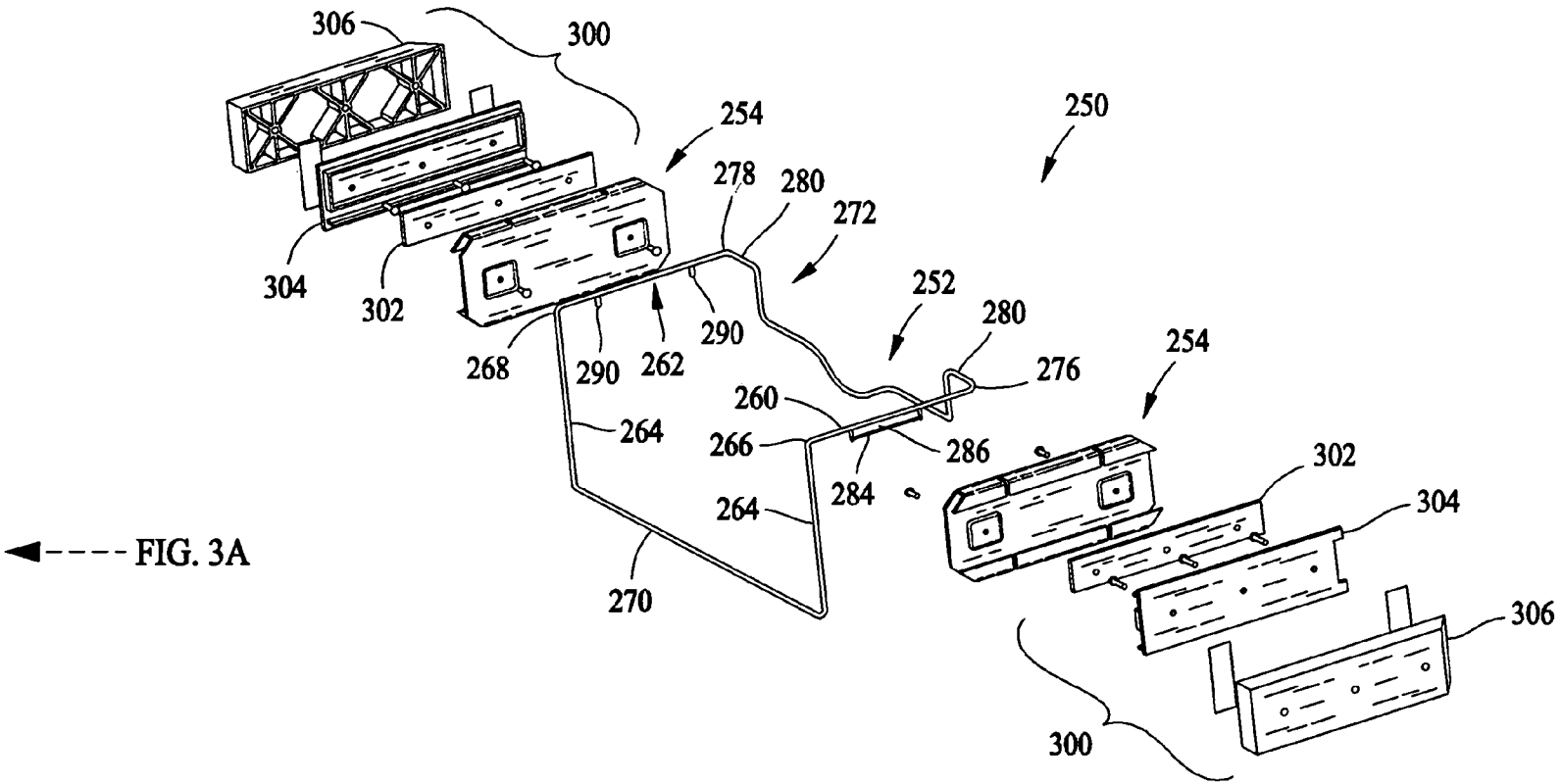

FIGS. 3A and 3B show a perspective exploded view illustrating a bottom pan assembly that includes bottom pan 122. Pan 122 includes opposite side walls 182, a bottom wall 184 extending between side walls 182 and a rear wall 186 including a cutout portion 187 for receiving air handler leading edge 168. Pan side walls 182 each include an outwardly projecting support member 188. Rear wall 186 includes rearward facing engagement tabs 190. A mounting groove 191 is formed in a forward edge 192 of bottom wall 184. A window 194 fabricated from a transparent material is received in a cover 196 that is attached to a front 198 of pan 122. Cover 196 includes an outwardly curved handle 200 for user manipulation to open and close pan 122.

When pan 122 is in a closed position, pan 122 is covered by a stationary cover assembly 210. Cover assembly 210 is attached to the interior of the refrigerator fresh food compartment 102. Cover assembly includes cover top 212 and a seal frame member 214. Rear gaskets 216, a front gasket 218, and side cover gaskets 220 are provided to facilitate sealing pan 122, particularly during operation of the quick chill and thaw system.

Bottom pan 122 is supported by a support assembly 250 that facilitates extension and retraction of pan 122 from fresh food compartment 102. Support assembly 250 includes a wire frame 252, and right and left brackets 254, which in an exemplary embodiment are substantially identical. Bottom pan 122 is received within wire frame 252 for snap fit engagement as will be described. Wire frame 252 is continuously formed and includes spaced apart right and left side arms 260 and 262 respectively. Front leg members 264 extend downwardly from forward ends 266 and 268 of side arms 260 and 262 respectively, and are joined by a front cross member 270. A rear cross member 272 connects rearward ends 276 and 278 of side arms 260 and 262 respectively. Rear cross member 272 includes pan mounting sections 280. Rear cross member 272 is formed to substantially conform to cutout portion 187 in rear wall 186.

Right side arm 260 includes a U-shaped member 284 attached thereto and defining a channel 286 between U-shaped member 284 and right side arm 260. U-shaped member 284 and channel 286 define a mounting location for right bracket 254. Left side arm 262 includes a pair of hooks 290 attached thereto that define a mounting location for left bracket 254.

A slide assembly 300 is coupled to each bracket 254. Slide assemblies 300 facilitate sliding movement of pan 122 out of and into fresh food compartment 102. Each slide assembly 300 is of well known construction and includes a slide pan 302, a slide liner 304 and a slide spacer 306. Slide pan 302 is coupled to bracket 254 while slide liner 304 and slide spacer 306 are attached to an interior wall of fresh food compartment 102. Slide assembly 300 is a full extension slide assembly that allows easy access to the contents of pan 122.

Figure 4:
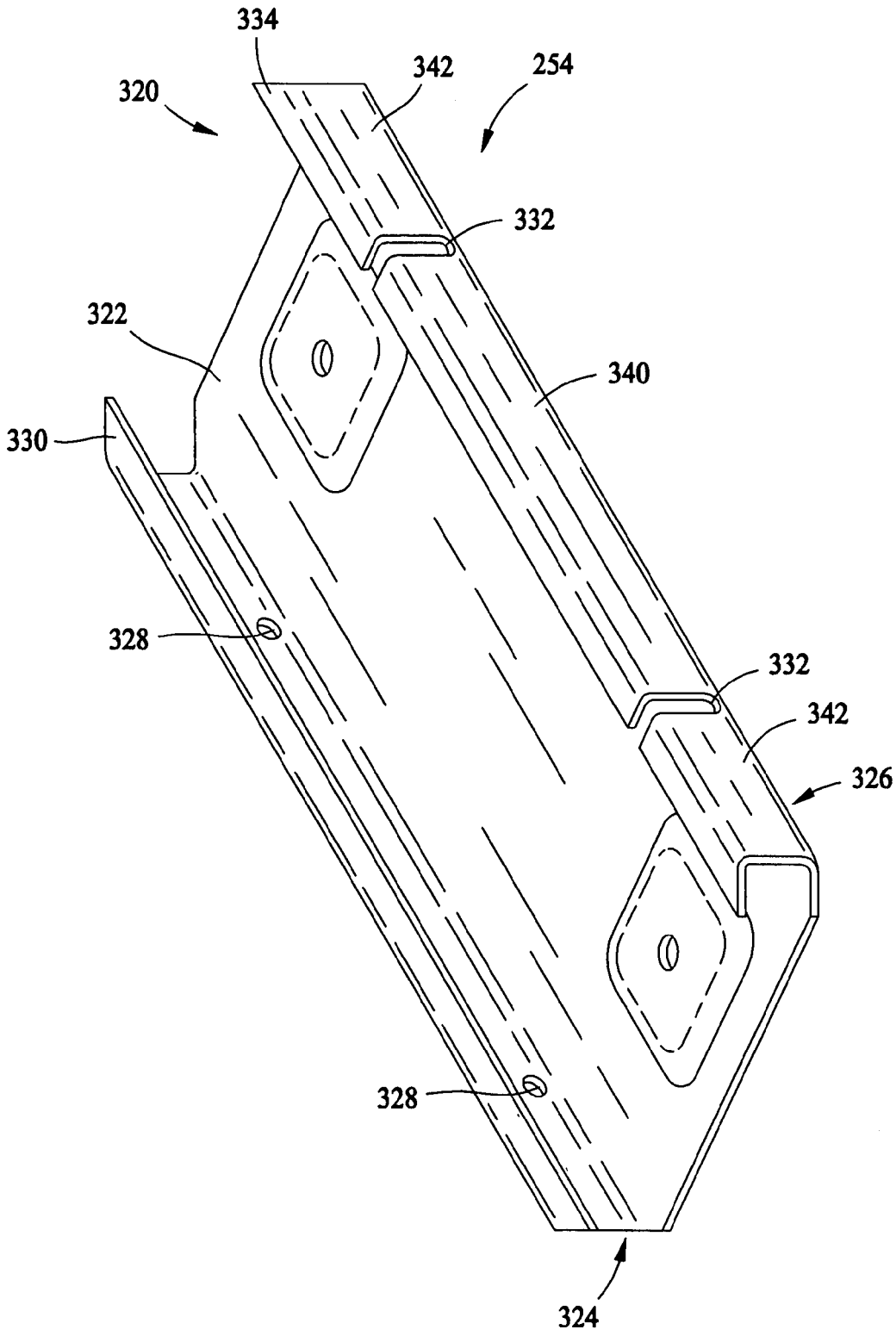
FIG. 4 is a perspective view of a slide bracket.

FIG. 4 illustrates bracket 254 in detail. Bracket 254 includes a generally C-shaped channel 320 that includes a side wall 322, a first rail 324 and an opposite second rail 326. First rail 324 includes apertures 328 and a lip 330. Apertures 328 are positioned on first rail 324 so as to coincide with and receive hooks 290 on left side arm 262. Second rail 326 includes slots 332 and a lip 334. Slots 332 extend across the width of rail 326 and also through lip 334 such that rail 326 is formed with a center section 340 between a pair of end sections 342. Center rail section 340 is sized to be received in channel 286 of right side arm 260.

The operation of pan support assembly 250 will be described with reference to FIGS. 5 and 6. Brackets 254 are used in pairs and are mounted on right side arm 260 (FIG. 5) and left side arm 262 (FIG. 6) inversely oriented from each other, that is, on right side arm 260, rail 326 is the upper rail, while on left side arm 262, rail 324 is the upper rail. It is to be understood that in alternative embodiments, this relationship could be reversed.

Figure 5:
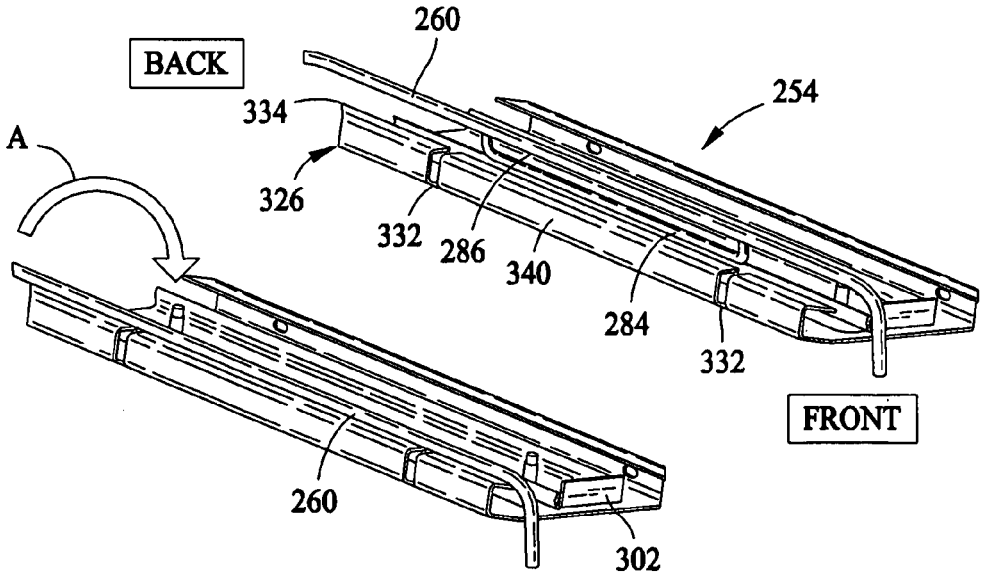
FIG. 5 is a perspective view of a right side bracket.

With reference to FIG. 5, bracket 254 is mounted on right side arm 260 by placing lip 334 of center rail section 340 into channel 286 and rotating bracket 254 in the direction of arrow A so that bracket 254 is suspended from U-shaped member 284. Thus, bracket 254 is mounted on right side arm 260 without tools. Conversely, bracket 254 is removable from right side arm 260 without tools.

Figure 6:
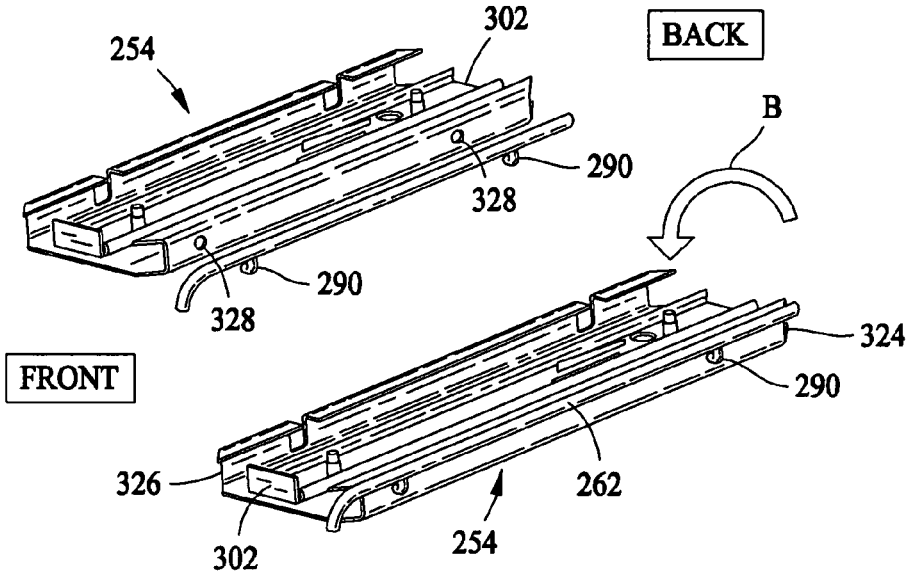
FIG. 6 is a perspective view of a left side bracket.

With reference to FIG. 6, bracket 254 is mounted on left side arm 262 by inserting hooks 290 into apertures 328 in rail 324 and rotating bracket 254 in the direction of arrow B so that bracket 254 is suspended from hooks 290. Thus, bracket 254 is also mounted on left side arm 262 without tools and similarly is removable from left side arm 262 without tools.

Bottom pan 122 is received within wire frame 252 with support members 188 resting on wire frame side arms 260 and 262. Pan rear wall engagement tabs 190 engage mounting sections 280 of wire frame rear cross member 272 providing rearward support for bottom pan 122. Wire frame front cross member 270 is received in snap fit engagement with groove 191 in forward edge 192 of bottom wall 184 thus securing pan 122 in wire frame 252. Thus bottom pan 122 is also installed in wire frame 252 without tools.

Figure 8:
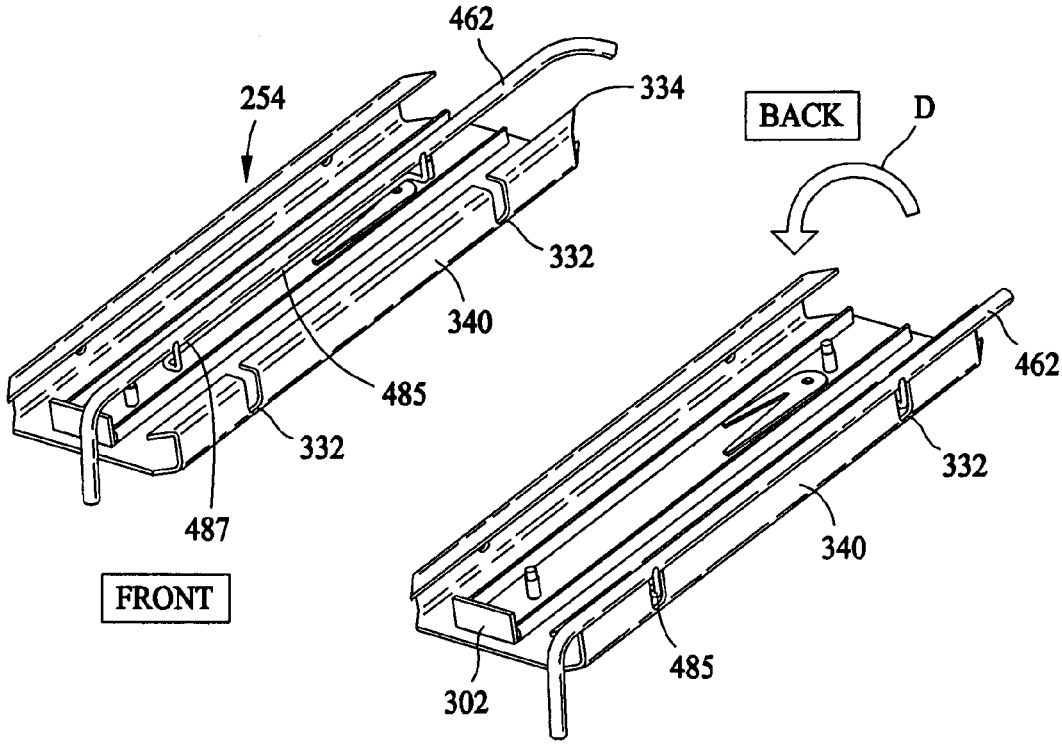
FIG. 8 is a perspective view of an alternative embodiment of a left side bracket.
Figure 7:
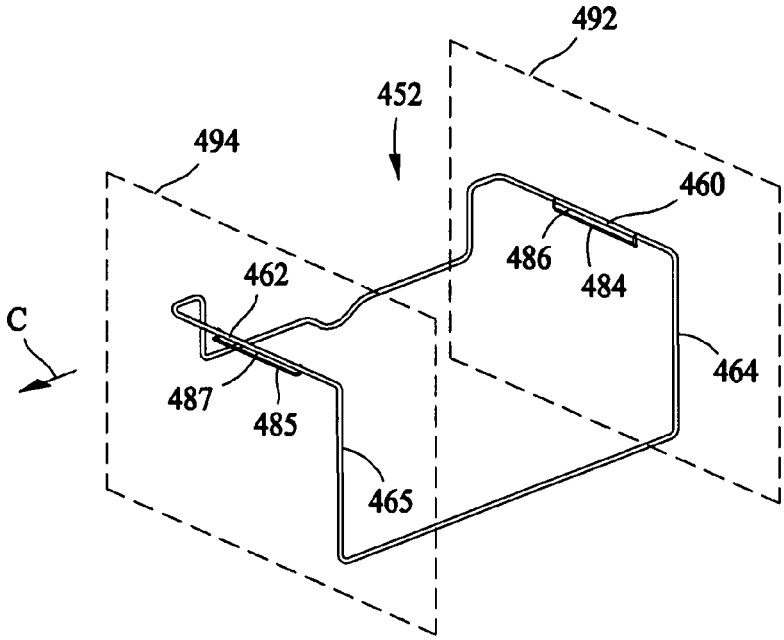
FIG. 7 is a perspective view of an alternative embodiment of a wire frame support.

FIGS. 7 and 8 illustrate an alternative embodiment of a wire frame 452 support for bottom pan 122. Wire frame 452 is used in conjunction with right and left support brackets 254 as shown in detail in FIG. 4. Wire frame 452 includes a right side arm 460 and a left side arm 462 and right and left front legs 464 and 465 respectively that extend downwardly from right and left side arms 460 and 462. Right side arm 460 and left side arm 462 include U-shaped members 484 and 485 respectively and channels 486 and 487 respectively for mounting support brackets 254. Right side arm 460 and right front leg member 464 define a plane 492 that includes right U-shaped member 484. In other words, right side arm 460 and right front leg member 464 form a right front portion and U-shaped member 484 is aligned with the right front portion. Left side arm 462 and left front leg member 465 form a left front portion which defines a plane 494. U-shaped member 485 of left side arm 462 extends exterior from plane 494 in the direction of arrow C. In other respects, wire frame 452 is similar to wire frame 252, previously described.

For right side arm 460, support bracket 254 is mounted as described above with respect to right side arm 260 and with reference to FIG. 5. For left side arm 462, support bracket 254 is mounted as shown in FIG. 8. Bracket 254 is mounted on left side arm 462 by placing lip 334 of center rail section 340 into channel 487 and rotating bracket 254 in the direction of arrow D so that bracket 254 is suspended from U-shaped member 485.

The embodiments thus described provide a bottom pan support assembly that can be easily removed and installed by an end user and requiring no tools for disassembly and assembly. The design is robust and reliable and easy to maintain. The assembly uses few parts which, when combined with simple installation without tools, lowers production costs. Additionally, service technicians require no extra tools to service the assembly.

While the invention has been described in terms of various specific embodiments, those skilled in the art will recognize that the invention can be practiced with modification within the spirit and scope of the claims.

What is claimed is:

1. A refrigerator drawer assembly comprising:

a pan support comprising a wire member having a first side and a second side;

a first bracket coupled to said first side using a first coupling system;

a second bracket coupled to said second side using a second coupling system different than the first coupling system wherein said second bracket is substantially identical to said first bracket; and wherein said first coupling system comprises a U-shaped wire member coupled to said first side, and said second coupling system comprises at least two hooks coupled to said second side, said first bracket coupled to said U-shaped wire member, said second bracket coupled to said hooks.

2. A refrigerator drawer assembly in accordance with claim 1 wherein said first and second brackets are coupled to said wire member such that they are removable without using tools.

3. A refrigerator drawer assembly in accordance with claim 1 wherein each said bracket comprises a first rail with slots and a second rail with holes, said first rail of one bracket coupled to one of said first and second sides and said second rail of the other bracket is coupled to the other of said first and second sides.

4. A refrigerator drawer assembly in accordance with claim 3 wherein said first rail of said first bracket is coupled to said first side, and said second rail of said second bracket is coupled to said second side.

5. A refrigerator drawer assembly in accordance with claim 4, wherein said first coupling system comprises a U-shaped wire member, and said second coupling system comprises at least two hooks.

6. A refrigerator drawer assembly in accordance with claim 1, wherein said first coupling system comprises a U-shaped wire member aligned with a right front portion of said pan support, and said second coupling system comprises a U-shaped wire member extending exterior to a plane defined by a left front portion of said pan support, said first bracket coupled to said U-shaped wire member aligned with said right front portion, said second bracket coupled to said U-shaped wire member extending exterior to the plane defined by said left front portion.

7. A method for assembling a refrigerator drawer assembly, said method comprising:

forming a pan support wire member from a continuous wire, the pan support wire member having a first side and a second side;

providing a plurality of substantially identical brackets including a first bracket and a second bracket;

removably coupling the first bracket to the first side using a first U-shaped member coupled to said first side; and removably coupling the second bracket to the second side using a plurality of hooks coupled to said second side.

8. A pan support assembly comprising:

a pan support wire member comprising a first side including a U-shaped member and a second side including a plurality of hooks; and a first bracket and a second bracket each comprising:

a sidewall;

a first rail extending from said sidewall, said first rail comprising a plurality of slots sized to receive said U-shaped member; and a second rail extending from said sidewall, said second rail comprising a plurality of apertures each sized to receive a hook extending from said pan support wire member; and wherein said first and said second rails each comprise an inwardly turned lip portion; and wherein said plurality of slots in said first rail of said first bracket receive said U-shaped member and said plurality of apertures in said second rail of said second bracket receive a corresponding hook of said plurality of hooks.

9. A pan support assembly in accordance with claim 8 wherein said second rail comprises a plurality of apertures each sized to receive a hook extending from the pan support wire member.

10. A refrigerator drawer assembly comprising:

a pan support comprising a continuously formed wire member having a first side and a second side, said first side having a U-shaped member defining a channel and said second side including a plurality of hooks;

a first bracket coupled to said first side such that said first bracket is removable without tools, said first bracket having a plurality of slots forming a lip positioned within said channel; and a second bracket coupled to said second side such that said second bracket is removable without tools, said second bracket defining a plurality of apertures receiving a corresponding hook of said plurality of hooks.

11. An assembly in accordance with claim 10 wherein said second bracket substantially identical to said first bracket.

12. An assembly in accordance with claim 10 wherein said first bracket coupled to said first side with a first coupling system, said second bracket coupled to said second side with a second coupling system different from said first coupling system.

* * * * *